US005163550A

United States Patent [19]

Hawk

[11] Patent Number: 5,163,550

[45] Date of Patent: Nov. 17, 1992

[54] PROTECTIVE COVER FOR SNOWBOARD OR THE LIKE

[76] Inventor: Christopher G. Hawk, 1109 Four Mile Canyon, Boulder, Colo. 80302

[21] Appl. No.: 824,579

[22] Filed: Jan. 23, 1992

[51] Int. Cl.[5] ..... B65D 85/00; A45C 11/00

[52] U.S. Cl. ..... 206/315.1; 224/901; 224/917

[58] Field of Search ..... 206/315.1; 224/901, 224/917; 150/154

[56] References Cited

U.S. PATENT DOCUMENTS 3,339,607 9/1967 Howard .
4,006,912 2/1977 Perlich et al. .
4,012,050 3/1977 Miller .
4,196,762 4/1980 Goodwin et al. .
4,483,380 11/1984 Beran .
4,644,986 2/1987 Fusaro .
4,719,952 1/1988 Geronimo .
4,793,535 12/1988 Johnson .
5,092,506 3/1992 Bolduc ..... 224/901

FOREIGN PATENT DOCUMENTS 625462 8/1961 Canada ..... 150/154

*Primary Examiner*—William I. Price
*Attorney, Agent, or Firm*—John E. Reilly

[57] ABSTRACT

A protective cover for snowboards is made up of an elastic elongated panel having an elastic cord around its outer peripheral edge which must be stretched in order to permit insertion of the snowboard such that the bottom of the snowboard is covered by the panel and the elastic cord snugly engages the top surface of the panel; and reinforcing layers are provided along the surrounding edge of the panel to overlap the edges of the snowboard.

12 Claims, 1 Drawing Sheet

PROTECTIVE COVER FOR SNOWBOARD OR THE LIKE

This invention relates to protective covers for sporting equipment; and more particularly relates to a novel and improved protective cover for snowboards, mono-boards and the like.

BACKGROUND AND FIELD OF THE INVENTION

Various types of protective covers have been devised for sports equipment. For example, C. Miller U.S. Pat. No. 4,012,050 discloses a rubber boot for skis having an elastic cover which can be stretched over a limited portion of the ski together with Velcro straps and relatively thick flanges which fit along the edges of the ski. F. J. Perlich et al U.S. Pat. No. 4,006,912 discloses an elastic cover with reinforced end portions that are recessed to receive the toe and heel portions of a ski and provided with special grooves therein. In J. D. Geronimo U.S. Pat. No. 4,719,952, a surfboard cover is more of a pocket-shaped arrangement which is open in the center and surrounds the edges of the surfboard. M. A. Beran U.S. Pat. No. 4,483,380 discloses more of a luggage-like foldable cover for surfboards, skis and the like.

Snowboarding has become increasingly popular as a winter sport, and snowboards present very much the same problems as skis in terms of protecting the running surfaces and edges when not in use and when being transported or shipped from place to place. For example, in placing on a ski rack or luggage carrier of a car the toe and heel portions of the snowboard are particularly susceptible to damage resulting from jarring or impact with other objects. Similarly, it is important that the undersurface and side edges be protected but at the same time to provide a covering which can be easily assembled and removed with respect to the snowboard and be easy to grip and carry when placed on the snowboard. Furthermore, when the protective cover is not in use, it can be folded or rolled into an extremely compact package which can be carried on one's person while snowboarding. Further in this connection, it is highly desirable that the protective cover be so constructed and arranged as to be capable of being secured in snug, form-fitting relation to the snowboard and yet leave the upper surface of the snowboard exposed so that, for example, the snowboard can be utilized in performing aerial exercises on a trampoline without damaging the surface of the trampoline.

SUMMARY OF THE INVENTION

It is therefore an object of the present invention to provide for a novel and improved covering for sports equipment and particularly for flat elongated articles, such as, snowboards, mono-boards and the like.

Another object of the present invention is to provide for a novel and improved protective cover for snowboards and the like which will effectively protect the bottom and edges from dents, scratches, chipping and other impact damage either during storage or transit while leaving the upper surface exposed, is extremely lightweight, compact and can be easily slipped on and off the snowboard.

It is a further object of the present invention to provide for a novel and improved protective cover including a one-piece panel which can be slipped into overlapping relation to the toe, heel and side edge portions of a snowboard while leaving the upper surface exposed, will automatically assume a form-fitting relationship to the snowboard and which when in place can be easily grasped and carried; and further wherein the protective covering is provided with additional reinforcement along the edges to minimize the possibility of damage to the edges or tearing of the cover by the edges.

It is an additional object of the present invention to provide a protective cover for snowboards and the like which is conformable for use with different widths and lengths of snowboards and will assume a snug, form-fitting relation to the snowboard when assembled in place.

In accordance with the present invention, a protective cover has been devised for snowboards and the like wherein the snowboard has a substantially flat elongated body with toe and heel portions at opposite ends and opposite side edges extending along the body between the toe and heel portions, the cover comprising an elastic elongated panel composed of a material capable of being stretched to a width and length greater than the width and length of the snowboard, the panel including toe and heel sections overlapping the toe and heel portions, respectively, of the snowboard and opposite side sections overlapping the side edges of the snowboard, and elastic securing means joins the toe, heel and opposite side sections together in snug-fitting relation to the snowboard. Preferably, the panel is a fabric reinforced rubber or rubber-like material, and the securing means is in the form of a high strength elastic cord extending along open edges of the toe, heel and side sections of the panel so as to draw the panel in against the top surface of the snowboard opposite to the bottom or running surface of the snowboard. Reinforcing layers extend along the toe, heel and opposite side sections of the panel so as to overlap the edges of the snowboard, and gripping straps extend across the side sections at spaced intervals over the top surface of the snowboard to facilitate grasping and handling of the snowboard when covered.

The above and other objects of the present invention will become more readily appreciated and understood from a consideration of the following detailed description of a preferred embodiment when taken together with the accompanying drawings wherein:

DETAILED DESCRIPTION OF THE PREFERRED EMBODIMENT

Figure 1:
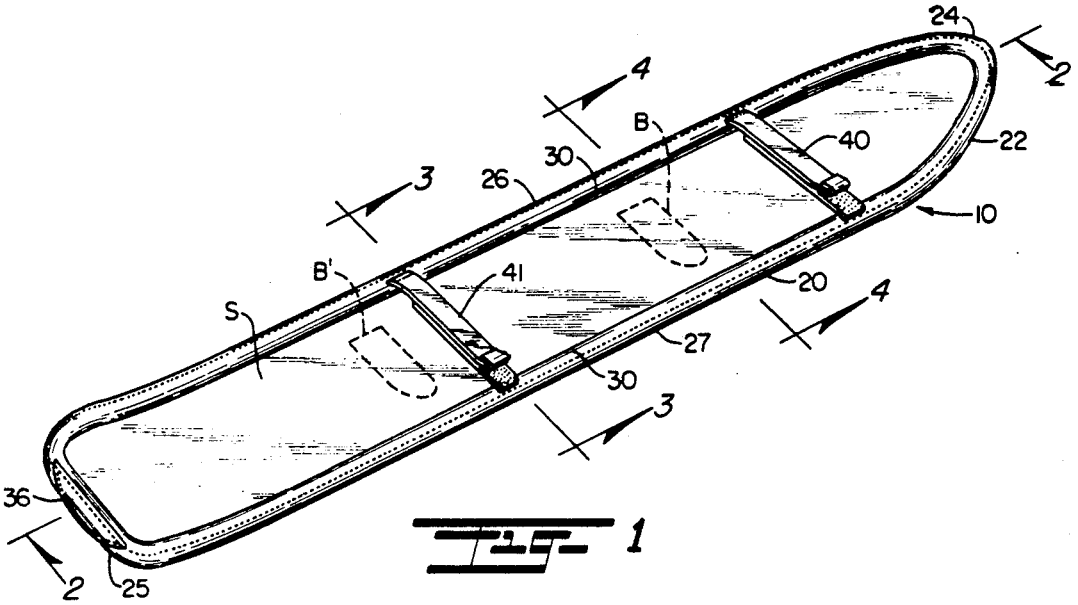
FIG. 1 is a perspective view of a preferred form of protective cover in assembled relation to a snowboard in accordance with the present invention.
Figure 2:
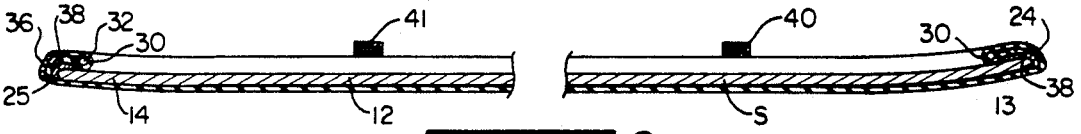
FIG. 2 is a cross-sectional view taken about lines 2—2 of FIG. 1.

Referring in more detail to the drawings, there is illustrated in FIGS. 1 to 4 a preferred form of protective cover 10 for a conventional snowboard as designated at S, although its adaptability for use with other sporting equipment will be readily appreciated. The conventional snowboard S is comprised of an elongated, substantially flat body 12 having a front tapered end or toe portion 13 which is curved upwardly, a squared heel portion 14 at the end opposite to the toe portion, and opposite side edge portions 15 and 16 extend in spaced parallel relation to one another between the toe and heel portions 13 and 14. The snowboard S includes a bottom running surface 17 and a top surface 18 to which bindings, not shown, are attached in the locations represented in dotted form at B and B'.

In accordance with the present invention, the preferred form of cover 10 is broadly comprised of an elongated panel 20 composed of an elastic, fabric reinforced rubber or rubber-like material to be described and being of generally rectangular configuration except for a front tapered end portion 22. The panel has an outer surrounding edge defined by a toe section 24, heel section 25 and opposite side sections 26 and 27 and which sections 24 to 27 form a continuous surrounding edge extending upwardly then inwardly from the flat lower surface of the panel 20 and terminate in a continuous upper peripheral edge 30. The peripheral edge 30 is doubled upon itself to define an opening or seam for insertion of an elastic cord 32. Preferably, the cord 32 is an elastic member, such as, a "BUNGY TM" cord which extends continuously around the toe 24, heel 25 and side sections 26, 27 by threading through the opening in the edge 30 and has opposite ends secured together with standard fastener clips, not shown, which are hidden inside of the edge 30. The cord is of a resiliency such that it will tend to draw the peripheral edge 30 inwardly until the entire panel fits snugly against the bottom surface 17 of the body 12 and the upper peripheral edge 30 fits snugly against the top surface 18.

Preferably, the panel 10 is composed of a sheet of fabric reinforced rubber material and specifically a nylon covered close cell sponge or foam neoprene which is on the order of 1.5 mm. thick. One suitable form of panel material is Model No. R1318 sold by Rubatex Company of Bedford, Virginia. The neoprene is characterized by being capable of being stretched both along its width and length and, for example, for a protective cover which is dimensioned to be 12" wide and 3' to 3.5' long is capable of being manually stretched on the order of 30° to 35°. In this way, the cover can be made to be conformable for different sized snowboards and nevertheless snugly engage the board. The neoprene material also offers the advantage of shock absorption and is extremely lightweight and flexible so as to be capable of being tightly folded or rolled for storage purposes when not in use and to such extent that it can be carried on one's person when snowboarding and occupy a minimum of space.

Figure 3:
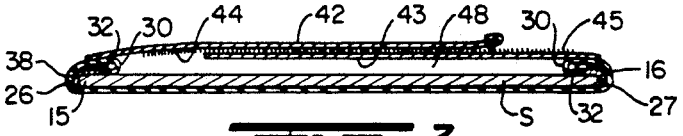
FIG. 3 is a cross-sectional view taken about lines 3—3 of FIG. 1.
Figure 4:
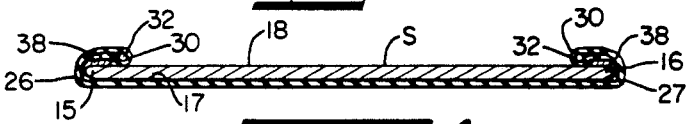
FIG. 4 is a cross-sectional view taken about lines 4—4 of FIG. 1.

In order to facilitate grasping or holding of the snowboard when the cover 10 is in place, strap members 40 and 41 are disposed at spaced intervals across the top of the cover so as to extend transversely of the length of the cover. Each of the strap members is correspondingly made up of a pair of straps 42 and 43 which extend from opposite side sections 26 and 27, respectively. The straps 42 and 43 have complementary Velcro strips 44 and 45, respectively, along the confronting surfaces of the straps when disposed in overlapping relation as shown in FIG. 3 so that they can be adjustably secured together while leaving a slight space or gap 48 to permit each to be conveniently gripped in the hand.

A reinforcing layer 36 is applied along the rearward extremity of the heel section 25 and may be formed out of the material of the panel 20 so as to effectively double the thickness of the panel at the heel portion 14; or, in the alternative, other materials may be employed, such as, a fabric or nylon which may be bonded or otherwise securely fastened to the external surface of the heel section 25 so as to afford added protection when the snowboard is placed on end in an upright position.

Preferably, the elastic cord 32 is composed of a high strength material, such as, a "BUNGY TM" cord but which has a greater resistance to stretch, or spring tension, than the panel. Accordingly, not only will the cord 32 be highly effective in causing the panel to assume form-fitting engagement with the board, but will reinforce the panel along its upper peripheral edge and securely retain it in position against the snowboard so as to discourage any accidental shifting or displacement of the panel when being handled or carried.

Figure 5:
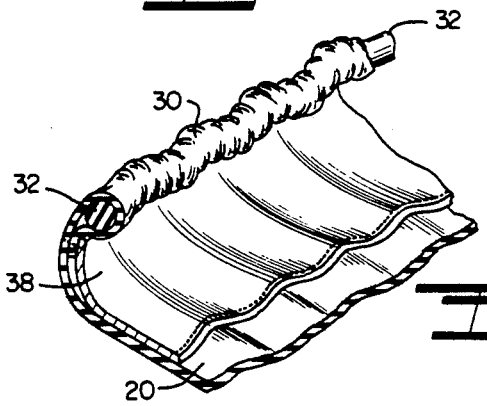
FIG. 5 is a view partially in section of the cover in its relaxed state.

As further illustrated in FIG. 5, a non-stretchable reinforcing strip 38 is disposed along the inner surface of the surrounding edge of the panel 20 not only to cover the edges along the toe, heel and opposite side sections of the snowboard but also to prevent the sharp edges of the snowboard from tearing the softer material of the panel. Preferably, the reinforcing strip 38 is of a length corresponding to the expanded dimension of the surrounding edge of the panel 20 so that, in the relaxed state as shown in FIG. 5, the reinforcing strip will become gathered or folded to compensate for the reduction in length around the surrounding edges of the panel. In this way, the reinforcing strip 38 may be composed of a high strength, non-stretchable material, such as, ballastics cloth customarily used in fabricating parachutes and which is flexible enough to assume the configuration and dimension of the panel and particularly the surrounding edges thereof when expanded into position over the snowboard. The reinforcing strip 38 is dimensioned in width to traverse only that portion extending from the upper peripheral edge 30 to a point just beyond the lower edge of the snowboard so that the remainder of the panel retains its ability to stretch to conform to the size of the snowboard.

One notable advantage of the preferred form of cover 10 as described is its ability not only to serve as a protective cover but also to permit use of the snowboard in performing aerial exercises on a trampoline. In particular, the reinforcing layers and strips as described will prevent any tearing or damage of the trampoline surface by the edges of the snowboard.

It is therefore to be understood that while a preferred form of protective cover has been herein set forth and described, various modifications and changes may be made therein without departing from the spirit and scope of the present invention as defined by the appended claims and reasonable equivalents thereof.

I claim:

1. A protective cover for snowboards and the like wherein the snowboard is provided with a flat elongated body having a bottom surface and top surface, toe and heel portions at opposite ends and opposite side edge portions extending along said body between said toe and heel portions, said cover comprising:

an elastic elongated panel having an outer surrounding edge, said panel being of a width and length in the relaxed state which is less than the width and length of said snowboard, said panel composed of a material capable of being stretched in the direction of its width and length to a dimension greater than the width and length of said snowboard with said outer surrounding edge including toe and heel sections overlapping said toe and heel portions, respectively, of said snowboard and opposite side sections overlapping said side edges of said snowboard; and securing means along said outer surrounding edge joining said toe, heel and opposite side sections together in snug-fitting relation to the top surface of said snowboard and said panel covering the bottom surface of said snowboard.

2. A protective cover according to claim 1, said securing means defined by an elastic cord secured to said toe, heel and side sections of said panel.

3. A protective cover according to claim 1, said toe and heel sections including reinforcing layers overlapping said toe and heel portions of said snowboard.

4. A protective cover according to claim 1, including strap members extending between said side sections at spaced intervals along the length of said panel and in spaced parallel relation to one another.

5. A protective cover according to claim 4, said strap members including a strap portion extending from each of said side sections and means adjustably fastening said strap portions together.

6. A protective cover according to claim 5, said adjustable fastening means being in the form of complementary Velcro strips at free ends of said strap portions.

7. A protective cover according to claim 1, said panel being composed of a fabric-reinforced rubber or rubber-like material, and a fabric reinforcing strip extending along an inner surface of said outer surrounding edge.

8. A protective cover according to claim 7, said reinforcing strip extending continuously along said outer surrounding edge and being of a length corresponding to the maximum length and width of said panel when stretched.

9. A protective cover according to claim 8, said elastic cord being of a resiliency such that it can be expanded to extend over said toe, heel and side edge portions of said snowboard and when released will contract firmly against the top surface of said snowboard to retain said cover securely in place.

10. A protective cover for snowboards and the like wherein the snowboard is provided with a flat elongated body having a bottom surface and top surface, toe and heel portions at opposite ends and opposite side edge portions extending along said body between said toe and heel portions, said cover comprising:

an elastic elongated panel having an outer surrounding edge, said panel of a width and length in the relaxed state less than the width and length of said snowboard, said panel composed of a material stretchable in the direction of its width and length to a dimension greater than the width and length of said snowboard with said outer surrounding edge including toe and heel sections overlapping said toe and heel portions, respectively, of said snowboard and opposite side sections overlapping said side edges of said snowboard;

a non-stretchable reinforcing strip extending along said outer surrounding edge; and securing means in the form of an elastic cord extending continuously through an upper peripheral edge of said surrounding edge for joining said toe, heel and opposite side sections together in snug-fitting, overlapping relation to said toe, heel and opposite side edge portions.

11. A protective cover according to claim 10, including strap members extending between said side sections in a direction transversely of the length of said panel, each of said strap members including a strap portion extending from each said side section, and means adjustably fastening said strap portions of each of said strap members together in overlying relation to the top surface of said snowboard.

12. A protective cover according to claim 10, said elastic cord having a spring tension greater than that of said panel, and said reinforcing strip being interposed between said outer surrounding edge and said toe, heel and opposite side edge portions of said panel.

* * * * *